US005142581A

United States Patent [19]

Tokuda et al.

[11] Patent Number: 5,142,581

[45] Date of Patent: Aug. 25, 1992

[54] MULTI-STAGE LINEAR PREDICTIVE ANALYSIS CIRCUIT

[75] Inventors: Kiyohito Tokuda; Atsushi Fukasawa; Satoru Shimizu; Yumi Takizawa, all of Tokyo, Japan

[73] Assignee: Oki Electric Industry Co., Ltd., Tokyo, Japan

[21] Appl. No.: 447,667

[22] Filed: Dec. 8, 1989

[30] Foreign Application Priority Data

Dec. 9, 1988 [JP] Japan ..... 63-310205

[51] Int. Cl.[5] ..... G10L 7/00

[52] U.S. Cl. ..... 381/36

[58] Field of Search ..... 381/31-43; 364/513.5, 724.1, 725, 728.03; 73/645, 646

[56] References Cited

U.S. PATENT DOCUMENTS 4,184,049 1/1980 Crochiere et al. ..... 381/41
4,378,469 3/1983 Fette ..... 364/728.03
4,389,540 6/1983 Nakamura et al. ..... 381/41
4,472,832 9/1984 Atal et al. ..... 381/40
4,544,919 10/1985 Gerson ..... 381/41
4,847,906 7/1989 Ackenhusen ..... 381/41
4,944,013 7/1990 Gouvianakis et al. ..... 381/38
4,961,160 10/1990 Sato et al. ..... 364/724.01

OTHER PUBLICATIONS

S. Kay and S. Marple, "Spectrum Analysis—A Modern Perspective," *Proceedings of the IEEE*, vol. 69, No. 11, Nov. 1981, pp. 1380-1419.

*Primary Examiner*—Michael R. Fleming
*Assistant Examiner*—Michelle Doerrler
*Attorney, Agent, or Firm*—Edward D. Manzo

[57] ABSTRACT

Features are extracted from a sample input signal by performing first linear predictive analyses of different first orders p on the sample values and performing second linear predictive analyses of different second orders q on the residuals of the first analyses. An optimum first order $\bar{p}$ is selected using information entropy values representing the information content of the residuals of the second linear predictive analyses. One or more optimum second orders $\bar{q}$ are selected on the basis of changes in these information entropy values. The optimum first and second orders are output as features. Further linear predictive analyses can be carried out to obtain higher-order features. Useful features are obtained even for nonstationary input signals.

9 Claims, 7 Drawing Sheets

MULTI-STAGE LINEAR PREDICTIVE ANALYSIS CIRCUIT

BACKGROUND OF THE INVENTION

This invention relates to a method of extracting features from an input signal by linear predictive analysis.

Feature extraction methods are used to analyze acoustic signals for purposes ranging from speech recognition to the diagnosis of malfunctioning motors and engines. The acoustic signal is converted to an electrical input signal that is sampled, digitized, and divided into fixed-length frames of short duration. Each frame thus consists of N sample values $x_1, x_2, \ldots, x_N$. The sample values are mathematically analyzed to extract numerical quantities, called features, which characterize the frame. The features are provided as raw material to a higher-level process. In a speech recognition or engine diagnosis system, for example, the features may be compared with a standard library of features to identify phonemes of speech, or sounds symptomatic of specific engine problems.

One group of mathematical techniques used for feature extraction can be represented by linear predictive analysis (LPA). Linear predictive analysis uses a model which assumes that each sample value can be predicted from the preceding p sample values by an equation of the form:

$$x_n = -(a_1 x_{n-1} + a_2 x_{n-2} + \ldots + a_p x_{n-p})$$

The integer p is referred to as the order of the model. The analysis consists in finding the set of coefficients $a_1, a_2, \ldots, a_p$ that gives the best predictions over the entire frame. These coefficients are output as features of the frame. Other techniques in this general group include PARCOR (partial correlation) analysis, zero-crossing count analysis, energy analysis, and autocorrelation function analysis.

Another general group of techniques employs the order p of the above model as a feature. Models of increasing order are tested until a model that satisfies some criterion is found, and its order p is output as a feature of the frame. The models are generally tested using the maximum-likelihood estimator $\sigma_p^2$ of their mean square residual error $\sigma_p^2$, also called the residual power or error power. Specific testing criteria that have been proposed include:

(1) Final predictive error (FPE)

$$FPE(p) = \sigma_p^2(N+P+1)/(N-P-1)$$

(2) Akaike information criterion (AIC)

$$AIC(p) = \ln(\sigma_p^2) + 2(p+1)/N$$

(3) Criterion autoregressive transfer function (CAT)

$$CAT(p) = \left(\left[(1/N)\sum_{j=1}^{P}(1/\sigma_j^2)\right]\right) - 1/\sigma_p^2$$

where, $\sigma_j^2 = [N/(N-j)]\sigma_p^2$. The order p found as a feature is related to the number of peaks in the power spectrum of the input signal.

A problem of all of these methods is that they do not provide useful feature information about short-duration input signals. The methods in the first group which use linear predictive coefficients, PARCOR coefficients, and the autocorrelation function require a stationary input signal: a signal long enough to exhibit constant properties over time. Short input signal frames are regarded as nonstationary random data and correct features are not derived. The zero-crossing counter and energy methods have large statistical variances and do not yield satisfactory features.

In the second group of methods, there is a tendency for the order p to become larger than necessary, reflecting spurious peaks. The reason is that the prior-art methods are based on logarithm-average maximum-likelihood estimation techniques which assume the existence of a precise value to which the estimate can converge. In actual input signals there is no assurance that such a value exists. In the AIC formula, for example, the accuracy of the estimate is severely degraded because the second term, which is proportional to the order, is too large in relation to the first term, which corresponds to the likelihood.

SUMMARY OF THE INVENTION

It is accordingly an object of the present invention to extract features from both stationary and nonstationary input signals.

Another object is to provide multiple-order characterization of the input signal.

A feature extraction method for extracting features from an input signal comprises steps of sampling the input signal to obtain a series of sample values, performing first linear predictive analyses of different first orders p on the sample values to generate residuals, performing second linear predictive analyses of different second orders q on these residuals to generate an information entropy value for each second order q, and outputting as features an optimum first order $\bar{p}$ and one or more optimum second orders $\bar{q}$. The optimum first order $\bar{p}$ is the first order p at which the information entropy value exceeds a first threshold. The optimum second orders $\bar{q}$ are those values of the second order q at which the change in the information entropy value exceeds a second threshold.

The method can be extended by generating further residuals in the second linear predictive analyses and performing third linear predictive analyses of different orders on these further residuals. In this case a single optimum second order $\bar{q}$ can be determined, and one or more third optimum orders $\bar{r}$ are also output as features. The method can be extended in analogous fashion to higher orders.

A feature extractor comprises a sampling means for sampling an input signal to obtain a series of sample values, and two or more stages connected in series. The first stage performs linear predictive analyses of different orders on the sample values, generates residuals, and selects an optimum order on the basis of information entropy values received from the next stage. Each intermediate stage performs linear predictive analyses of different orders on residuals received from the preceding stage, generates residuals and information entropy values, and selects an optimum order on the basis of information entropy values received from the next stage. The last stage performs linear predictive analyses of different orders on residuals received from the preceding stage, generates information entropy values, and selects one or more optimum orders on the basis of changes in these information entropy values. All selected optimum orders are output as features.

DETAILED DESCRIPTION OF THE INVENTION

A novel feature extraction method and feature extractor will be described with reference to the drawings.

Figure 1:
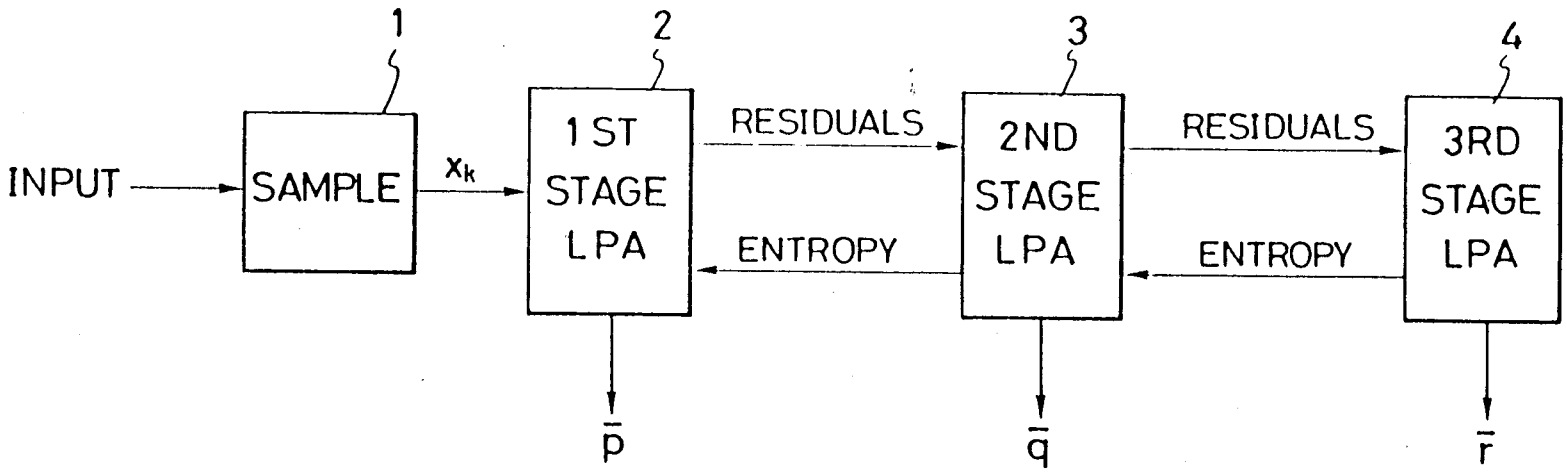
FIG. 1 is a block diagram illustrating the general plan of the invention.

FIG. 1 is a block diagram illustrating the general plan of the novel feature extractor. An input signal such as an acoustic signal which has been converted to an analog electrical signal is provided to a sampling means 1. The sampling means 1 samples the input signal to obtain a series of sample values $x_n$. The sampling process includes an analog-to-digital conversion process, so that the sample values $x_n$ are output as digital values. The output sample values are grouped into frames of N samples each, where N is preferably a power of two. The succeeding discussion will deal with a frame of sample values $x_1, x_2, \ldots, x_N$.

Feature extraction is performed in a sequence of two or more stages, which are connected in series. In FIG. 1 three stages are shown in order to illustrate first, intermediate, and last stages.

The first stage 2 receives the sample values from the sampling means 1 and performs linear predictive analyses of different orders p on them, thus generating residuals which represent the difference between predicted and actual sample values. The first stage 2 also receives information entropy values from the second stage 3, on the basis of which it selects an optimum order $\bar{p}$ for output as a feature.

The second stage 3, which is an intermediate stage in FIG. 1, receives the residuals generated in the first stage 2 and performs linear predictive analyses of different orders q on them,, thus generating further residuals. For each order q, the second stage 3 also generates an information entropy value representing the information content of the residuals generated by the corresponding linear predictive analysis. The second stage 3 receives similar information entropy values from the third stage 4, on the basis of which it selects an optimum order $\bar{q}$ for output as a feature.

The third stage 4, which is the last stage in FIG. 1, receives the residual values generated in the second stage 3 and performs linear predictive analyses of different orders r on them. For each order r, the third stage 4 generates an information entropy value representing the information content of the corresponding residuals, but does not generate the residuals themselves. On the basis of changes in these information entropy values, the third stage 4 selects one or more optimum orders $\bar{r}$ for output as features.

Next a more detailed description of the structure of the feature extractor stages and features extraction method will be given. For simplicity, only two stages will be shown, a first stage and a last stage. In feature extractors with intermediate stages, the intermediate stages comprise an obvious combination of structures found in the first and last stages.

Figure 2:
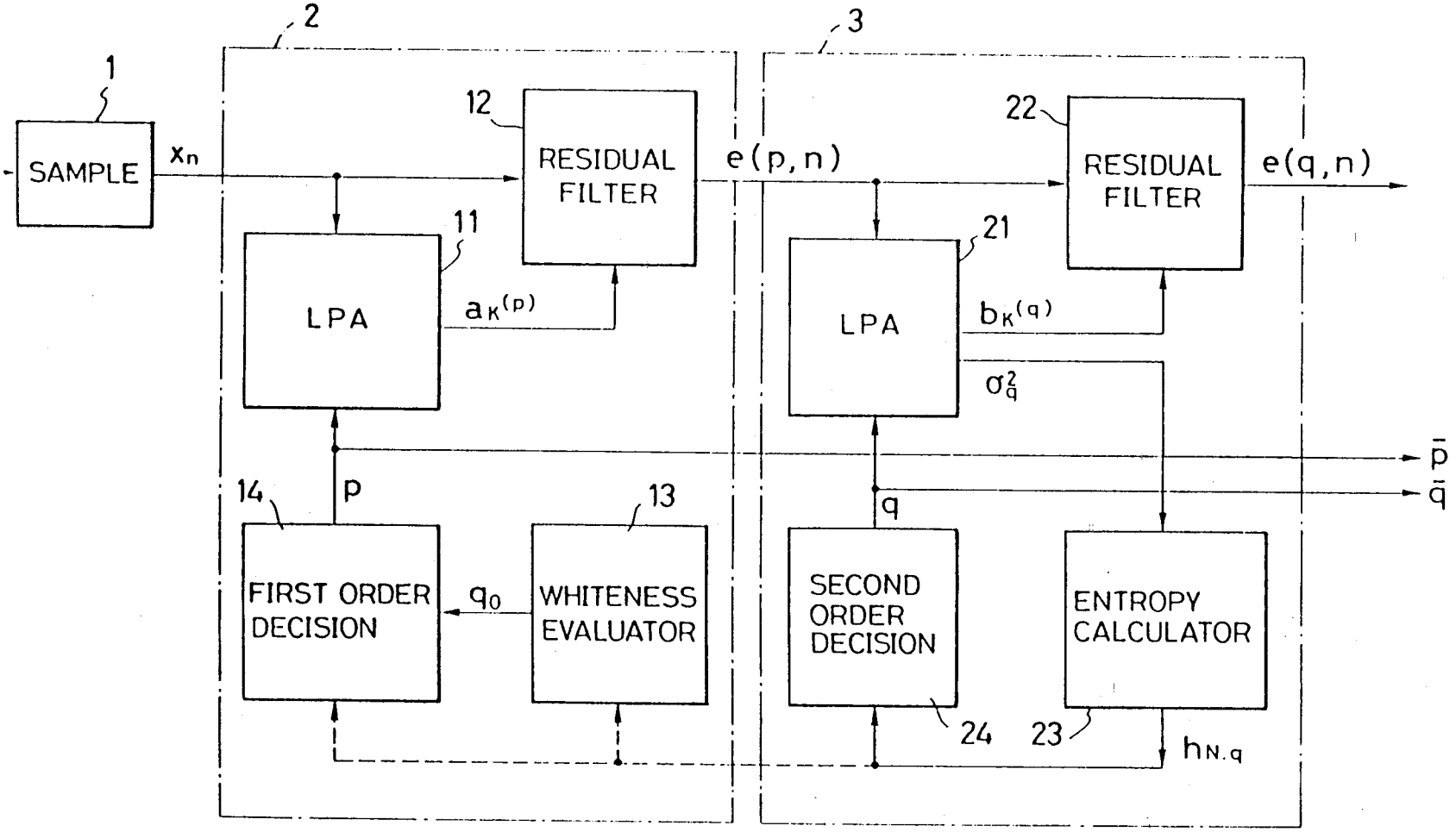
FIG. 2 is a block diagram illustrating an embodiment of the invention having two stages.

With reference to FIG. 2, the first stage 2 comprises a first linear predictive analyzer 11 that receives the sample values $x_1, \ldots, x_N$ from the sampling means 1, receives a first order p from a first order decision means to be described later, and calculates a set of linear predictive coefficients $a_1, \ldots, a_p$. As a notational convenience, to indicate that these coefficients belong to a specific order p, a superscript (p) will be added and the coefficients will be written as $a_k^{(p)}$ (k=1, 2, . . . p). The linear predictive coefficients $a_k^{(p)}$ are selected so as to minimize first residuals e(p,n) (n=p+1, p+2, . . . N), which are defined as follows:

$$e(p,n)=x_n+a_1^{(p)}x_{n-1}+a_2^{(p)}x_{n-2}+\ldots+a_p^{(p)}x_{n-p}$$

More specifically, the linear predictive coefficients are selected so as to minimize the sum of the squares of the residuals, which will be referred to as the residual power and denoted $\sigma_p^2$. The residual power $\sigma_p^2$ is representative of the mean square error of the first linear prediction analysis; the mean square error could be calculated by dividing the residual power by the number of residuals.

The first linear predictive analyzer 11 provides the coefficients $a_k^{(p)}$ to a residual filter 12, which also receives the sample values $x_1, \ldots, x_N$ from the sampling means 1 and calculates the values of the residuals e(p,n). The residuals e(p,n) are provided to the second stage 3.

The first stage 2 also comprises a whiteness evaluator 13 for receiving information entropy values $h_{N,q}$ from the second stage 3 and mutually compariing them to find a whitening order $q_0$ beyond which the information entropy values $h_{N,q}$ derease at a substantially constant rate. The whitening order $q_0$ can be interpreted as the order beyond which the residuals produceed in the second stage have the characteristics of white noise.

The whiteness evaluator 13 provides the whitening order $q_0$ to a first order decision means 14, which also receives the corresponding information entropy value from the second stage 3. The first order decision means 14 stores and increments the first order p, and provides the first order p to the first linear predictive analyzer 11, thus causing it to perform linear predictive analyses of different first orders p, the initial order being p=41. The first order decision means 14 also tests whether the information entropy value corresponding to the whitening order $q_0$ exceeds a certain first threshold. If it does, the current first order p is considered an optimum order, correctly reflecting the number of first-order peaks in the power spectrum of the input signal. The first order decision means 14 then stops incrementing p and outputs this optimum first order, denoted $\bar{p}$, as a feature.

The second stage 3 comprises a second linear predictive analyzer 21 for receiving the residual values e(p,n) from the first stage 2 and a second order value q from a second order decision means to be described later, and performing a second linear predictive analysis for order q on the received residual values. The second linear predictive analysis is similar to the first linear predictive analysis performed in the first stage 2. The second linear predictive analyzer 21 calculates and outputs a residual power $\sigma_q^2$ representative of the mean square error in the second linear predictive analysis. If there is a third stage, the second linear predictive analyzer 21 also outputs a set of linear predictive coefficients $b_k^{(q)}$ to a second residual filter 22.

The second residual filter 22, which need be provided only if there is a third stage, receives the residuals e(p,n) from the first stage 2 and the linear predictive coefficients $b_k^{(q)}$ from the second linear predictive analyzer 21, and calculates a new series of residuals e(q,n) as follows:

$$e(q,n)=e(p,n)+b_1^{(q)}e(p,n-1)+\ldots+b_q^{(q)}e(p,n-q)$$

The residuals e(q,n) need to be output to the third stage, if present, only when the optimum first order $\bar{p}$ has been determined. The second and third stages can then analyze the residuals $e(\bar{p},n)$ of the optimum first order $\bar{p}$ in the same way that the first and second stages analyzed the sample valuees $x_1, \ldots, x_N$.

The second stage 3 also comprises an entropy calculator 23 for receiving the residual power $\sigma_q^2$ from the second linear predictive analyzer 21 and calculating an information entropy value $h_{N,q}$. Details of the calculation will be shown later. The entropy calculator 23 provides the information entropy value $h_{N,q}$ to the first stage 2 as already described.

The entropy calculator 23 also provides the information entropy value $h_{N,q}$ to a second order decision means 24. The second order decision means 24 stores and increments the second order q and provides it to the second linear predictive analyzer 21, causing the second linear predictive analyzer 21 to perform second linear predictive analyses of different orders q. The second order should start at q=1 and proceed up to a certain maximum value such as q=100, preferably in steps of one. The second order decision means 24 also stores the information entropy values $h_{N,q}$ received from the entropy calculator 23 for different values of q, compares them, and selects as optimum those values of the second order q at which the change in the information entropy value $h_{N,q}$ exceeds a certain second threshold. This method of selecting optimum second orders q is used when, as in FIG. 2, no information entropy values are received from a higher stage. The optimum second orders q, collectively denoted $\bar{q}$, are output as features.

The first and second stages can be assembled from standard hardware such as microprocessors, floating-point coprocessors, digital signal processors, and semiconductor memory devices. Alternatively, special-purpose hardware can be used. As another alternative, the entire feature extraction process can be implemented in software running on a general-purpose computer.

Next the theory of operation and specific computational procedures will be described.

The novel feature extraction method assumes that the input signal $x_n$ can be described by an autogressive model of some order p:

$$x_n = -\sum_{k=1}^{p} a_k x_{n-k} + e_n \tag{1}$$

in which the $e_n$ are a Gaussian white-noise series, i.e. a series of Gaussian random variables satisfying the following conditions:

$$E[e_n]=0$$

$$E[e_n \cdot e_j]=E[e_n \cdot x_{n-j}]=\sigma_p^2\delta_{nj}$$

where $\delta_{nj}$ is the Kronecker delta symbol, the value of which is one when j=n and zero when m≠n. The coefficients $a_k^{(p)}$ (k=1, 2, . . . p) are calculated from the well-known Yule-Walker equations:

$$r_j + \sum_{k=1}^{p} a_k r_{j-k} = 0 \ (j \geqq 1) \tag{2}$$

$$r_0 + \sum_{k=1}^{p} a_k r_k = \sigma_p^2$$

$$r_j = E[x_n \cdot x_{n-j}]$$

The operator E[ ]conventionally denotes expectation, but in this invention it is given the computationally simpler meaning of summation. In equation (2), for example, $E[x_n \cdot x_{n-j}]$ denotes the sum of all products of the form $x_n \cdot x_{n-j}$ as n varies from 1 to N.

In the first linear predictive analyzer 11, the Yule-Walker equations are solved using the well-known Levinson-Durbin algorithm. This algorithm is recursive in nature, the coefficients $a_k^{(p)}$ being derived from the coefficients $a_k^{(p-1)}$ by the formulas:

$$a_{k(p)} = a_{k-1(p-1)} + \gamma_{A,p} a_{p-k(p-1)} \tag{3}$$

$$(k = 1, 2, \ldots p-1)$$

$$a_{p(p)} = \gamma_{A,p}$$

The p-th autocorrelation coefficient $r_p$ is calculated as follows:

$$r_p = -\sum_{k=1}^{p-1} r_{p-k} a_{k(p-1)} - \gamma_{A,p} \cdot \sigma_{p-1}^2 \ (p \geqq 1) \tag{4}$$

$$r_0 = \sum_{n=1}^{N} x_n^2 \tag{5}$$

The quantities $\gamma_{A,p}$, which are referred to as average reflection coefficients, can be calculated, for example by the maximum entropy method. A residual filter of order p is described by the following equation on the z-plane:

$$A_p(z^{-1}) = 1 + (a_1^{(p-1)} + \gamma_p a_{p-1}^{(p-1)})z^{-1} + \ldots$$

$$+ (a_{p-1}^{(p-1)} + \gamma_p a_1^{(p-1)})z^{-(p-1)} + \gamma_p z^{-p} \tag{6}$$

The average reflection coefficients are determined so as to minimize the mean square of the residual when a stationary input signal is filtered by this residual filter. Writing $x_m(1)$ for $x_m$, $x_m(2)$ for $x_{m+1}$, and so on, consider P−p series of sample valuues, each consisting of p+1 values:

$$\{x_m(1), x_m(2), \ldots, x_m(p+1)\}, \ m=1, 2, \ldots, N-p$$

The mean square value of $I_1$ of the residual when these series are filtered in the forward direction is:

$$\begin{aligned} I_1 &= \sum_{m=1}^{N-p} [\gamma_p x_m(1) + (a_{p-1(p-1)} + {}_p a_{1(p-1)})x_m(2) + \ldots + \\ &\quad (a_{1(p-1)} + {}_p a_{p-1(p-1)})x_m(p) + x_m(p+1)] \\ &= \sum_{m=1}^{N-p} [\gamma_p(x_m(1) + a_{1(p-1)}x_m(2) + \ldots + \\ &\quad a_{p-1(p-1)}x_p(N)) + (a_{p-1(p-1)}x_m(2) + \ldots + \\ &\quad a_{1(p-1)}x_m(p) + x_m(p+1))] \end{aligned} \tag{7}$$

Let the forward residual $f_{p,m}$ be defined as:

$$f_{p,m} = a_{p-1}^{(p-1)} x_m(2) + \ldots + a_1^{(p-1)} x_m(p) - x_m(p+1) \quad (8)$$

and the backward residual $b_{p,m}$ be defined as:

$$b_{p,m} = x_m(1) - a_1^{(p-1)} x_m(2) + \ldots + a_{p-1}^{(p-1)} x_m(p) \quad (9)$$

The mean square residual $I_1$ is then:

$$I_1 = \sum_{m=1}^{N-p} (f_{p,m} + \gamma_p \cdot b_{p,m})^2 \quad (10)$$

If the input signal $x_k$ is known to be stationary, the mean square residual $I_2$ when it is filtered by the residual filter in the backward direction is:

$$I_2 = \sum_{m=1}^{N-1} (b_{p,m} + \gamma_p \cdot f_{p,m})^2 = I_1 \quad (11)$$

If the signal is nonstationary, so that $I_2 \neq I_1$, the average $I_A = (I_1 + I_2)/2$ can be used. The p-th average reflection coefficient $_{A,p}$ must satisfy:

$$\partial I_A / \partial \gamma_{A,p} = 0$$

The solution is:

$$\gamma_{A,p} = -2 \sum_{m=1}^{N-p} f_{p,m} \cdot b_{p,m} / \sum_{m=1}^{N-p} (f_{p,m}^2 + b_{p,m}^2) \quad (12)$$

The linear predictive coefficients $a_k^{(p)}$ are calculated from the foregoing equations (3), (5), and (12) and sent to the residual filter 12.

The residual filter 12 convolves the N sample values $x_n$ with the linear predictive coefficients $a_k^{(p)}$ calculated by the first linear predictive analyzerr 11 to obtain the residuals e(p,n). The computation is carried out using the following modified form of equation (1), and the result is sent to the second stage 3.

$$e(p, n) = x_n + \sum_{k=1}^{p} a_k x_{n-k} \quad (13)$$

In the second stage 3, the second linear predictive analyzer 21 carries out a similar linear predictive analysis on the residuals e(p,n) to compute linear predictive coefficients $b_k^{(q)}$. It also uses the average reflection coefficients $\gamma_{A,q}$ derived during the computation to calculate the residual powers $\sigma_q^2$ according to the following recursive formula:

$$\sigma_q^2 = \sigma_{q-1}^1 (1 - \gamma_{A,q}^2) \quad (14)$$

The second residual filter 22 generates the residual values e(q,n), if required, by the same process as the first residual filter 12.

The entropy calculator 23 calculates the information entropy value for each order according to the residual power received from the second linear predictive analyzer 21. This calculation can be performed iteratively as described below.

Let $S_q(f)$ be the power spectrum of the residuals e(q,n) estimated by the second residual filter, and let $f_N$ be the Nyquist frequency, equal to half the sampling frequency. The entropy density $h_{d,q}$ is defined as:

$$h_{d,q} = \frac{1}{4f_N} \int_{-f_N}^{f_N} \ln S_q(f) df = (\tfrac{1}{2}) \ln \sigma_q^2 - (\tfrac{1}{2}) \ln 2f_N \quad (15)$$

Equation (14) can be expressed as follows:

$$\sigma_q^2 = \sigma_0^2 \prod_{i=1}^{q} (1 - \gamma_{A,i}^2) \quad (16)$$

From equation (16), the entropy density $h_{d,q}$ is:

$$h_{d,q} = (\tfrac{1}{2}) \ln \prod_{i=1}^{q} (1 - \gamma_{A,i}^2) + (\tfrac{1}{2}) \ln(\sigma_0^2 / 2f_N) \quad (17)$$

The information entropy value $h_{N,q}$ is obtained from the entropy density $h_{d,q}$ by subtracting the constant term on the right, thereby normalizing the value according to the zero-order residual power $\sigma_0^2$.

$$h_{N,q} = h_{d,q} - (\tfrac{1}{2}) \ln(\sigma_0^2 / 2f_N) = (\tfrac{1}{2}) \ln \prod_{i=1}^{q} (1 - \gamma_{A,i}^2) \quad (18)$$

This value is sent to the whiteness evaluator 13, the first order decision meanns 14, and the second order decision means 24.

It will be apparent from equation (18) that instead of providing the residual powers $\sigma_q^2$ to the entropy calculator 23, the second linear predictive analyzer 21 can provide the average reflection coefficients $\gamma_{A,q}$.

The information entropy values $h_{N,q}$ are negative numbers that decrease with increasing values of q. In general, there will be an initial interval of abrupt decrease followed thereafter by a more gradual decrease at a substantially constant rate signifying white-noise residuals. The whiteness evaluator 13 mutually compares the information entropy values $h_{N,q}$ output by the entropy calculator 23 for different valves of q, finds an order beyond which no further abrupt drops in information entropy occur, and selects this order as the whitening order $q_0$. The whitenning order $q_0$ is sent to the first order decision means 14 to be used in determining the optimum order $\bar{p}$ of the first linear predictive analyzer 11.

The first order decision means 14 receives the whitening order $q_0$ and the corresponding information entropy value, and tests this information entropy value to see whether it exceeds a first threshold. The first threshold, which should be selected in advance on an empirical basis, represents a saturation threshold of the whitened information entropy. If the corresponding entropy value does not exceed the first threshold, the first order decision means 14 increments p by one and the first predictive analysis is repeated with the new order p. The second linear predictive analyses are also repeated, for all second orders q. If the corresponding entropy value exceeds the first threshold, the first order decision means 14 halts the process and outputs the current first order as the optimum first order $\bar{p}$.

The optimum second orders output as features are selected on the basis of the residuals $e(\bar{p}, n)$ output by the first residual filter 12 at the optimum first order $\bar{p}$. Specifically, the second order decision means 24 calculates the change in information entropy $\Delta h_{N,q}$ between successive information entropy values:

$$\Delta h_{N,q} = h_{N,q} - h_{N,q-1}$$

The second order decision means 24 also calculates the mean $\Delta h_{N,q}$ and standard deviation $\sigma_{h,q}$ of $\Delta h_{N,q}$. the mean $\Delta h_{N,q}$ can conveniently be calculated as the difference between the first and last information entropy valuees divided by the number of information entropy values minus one. The second threshold is then set as the difference between the mean and standard deviation:

$$\text{Second threshol} = \Delta h_{N,q} - \sigma_{h,q}$$

The second order decision means 24 selects as optimum second orders all those second orders q for which $\Delta h_{N,q}$ exceeds the second threshold. Since $\Delta h_{N,q}$ and the second threshold are both negative in sign, "exceeds" means in the negative direction. The criterion is:

$$h_{N,q} - h_{N,q-1} < \Delta h_{N,q} - \sigma_{h,q}$$

When the input signal has known properties, the feature extraction process can be simplified by selecting a fixed whitening order $q_0$ in advance instead of calculating a separate whitening order $q_0$ for every first order p. The whiteness evaluator 13 can then be eliminated, and the number of second linear predictive analyses can be greatly reduced. Specifically, at first orders p less than the optimum order $\bar{p}$ the second linear predictive analyzer 21 only has to iterate the Levinson-Durbin algorithm $q_0$ times to determine the first $q_0$ average reflection coefficients, and the entropy calculator 23 only has to calculate the information entropy value corresponding to $q_0$. The full calculation for al second order values q only has to be performed once, at the optimum first order $\bar{p}$.

Next, the extraction of features by the novel method will be illustrated with reference to FIGS. 3 to 6.

Figure 3:
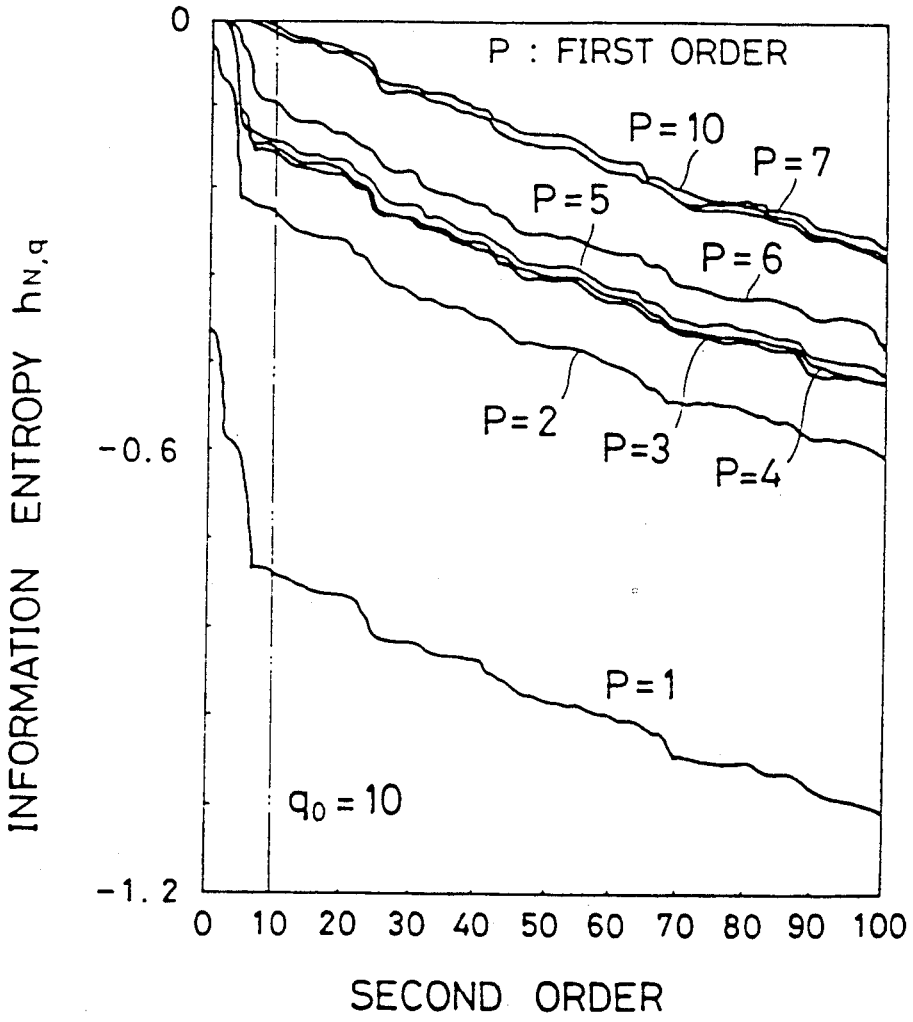
FIG. 3 illustrates whiteness evaluation.

FIG. 3 illustrates the evaluation of the whiteness of the second-order residuals. The second order q is shown n the horizontal axis, and the information entropy value $h_{N,q}$ on the vertical axis. As the first order p varies from one to ten, the information entropy curves gradually rise toward a saturation state. The curves generally comprise an initial abruptly-dropping part followed thereafter by a more gradual decrease at a substantially constant rate, as described earlier. For all values of p, the abrupt drop is confined to values of q less than ten. For input signals of the type exemplified in this drawing, the whitening order $q_0$ may preferably be fixed at a value such as $q_0 = 10$.

Figure 4:
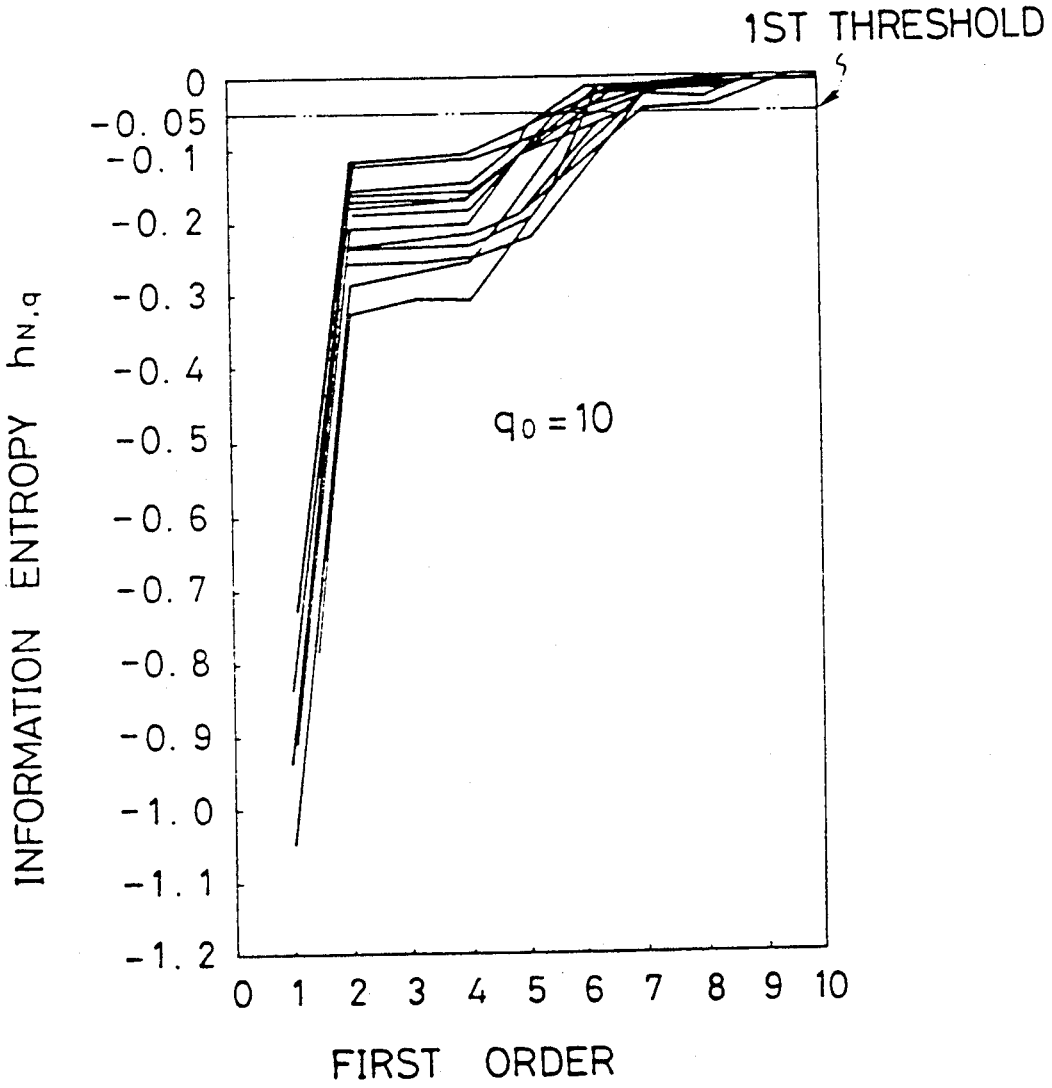
FIG. 4 illustrates determination of the first order.

FIG. 4 illustrates the determination of the optimum first order $\bar{p}$ in a number of different frames of an input signal of the same type as in FIG. 3. The first order p is shown on the horizontal axis, and the information entropy value $h_{N,q}$ on the vertical axis. The second order q is the fixed whitening order $q_0 = 10$ selected in FIG. 3. The first threshold is $-0.05$, a value set on the basis of empirical data such as the data in FIG. 4. For the frames shown, the optimum first order $\bar{p}$ lies in the vicinity of six.

Figure 5:
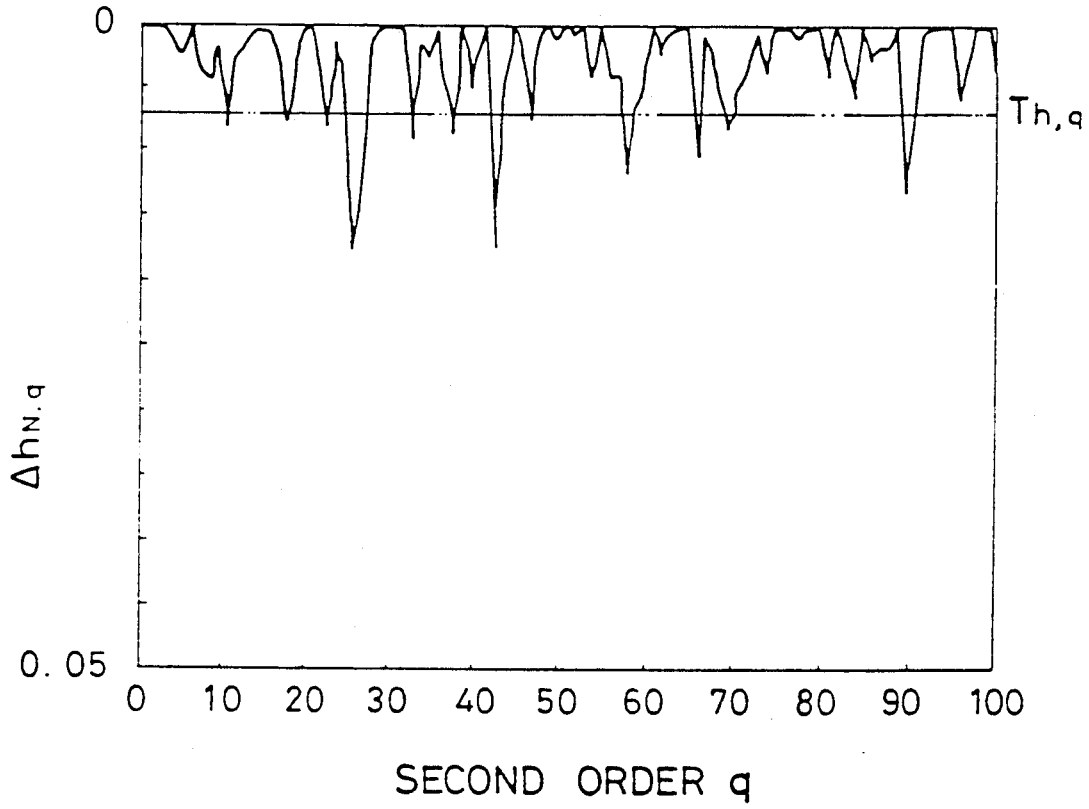
FIG. 5 illustrates determination of the second order.

FIG. 5 illustrates the selection of optimum second orders $\bar{q}$ for a single frame. The second order q is shown on the horizontal axis, and the information entropy change $\Delta h_{N,q}$ on the vertical axis. For the data in this frame, the mean value $\Delta h_{N,q}$ is $-3.22 \times 10^{-3}$ and the standard deviation $\sigma_{h,q}$ is $3.91 \times 10^{-3}$, so the second threshold is $-7.13 \times 10^{-3}$. The information entropy change $\Delta h_{N,q}$ exceeds the second threshold at $q = 10$, $q = 17$, and other values of q, which are output as optimum orders $\bar{q}$. Thus $\bar{q} = \{10, 17, \ldots\}$.

Figure 6A:
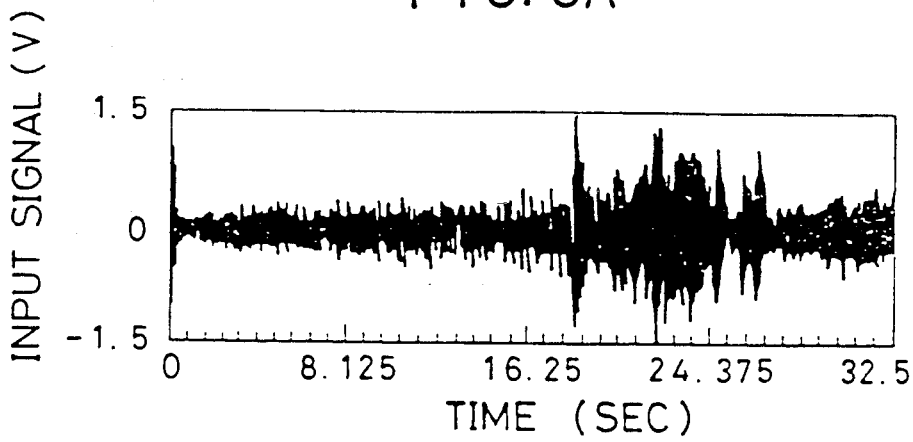
FIGS. 6A–C shows an example of features extracted by the invention.
Figure 6B:
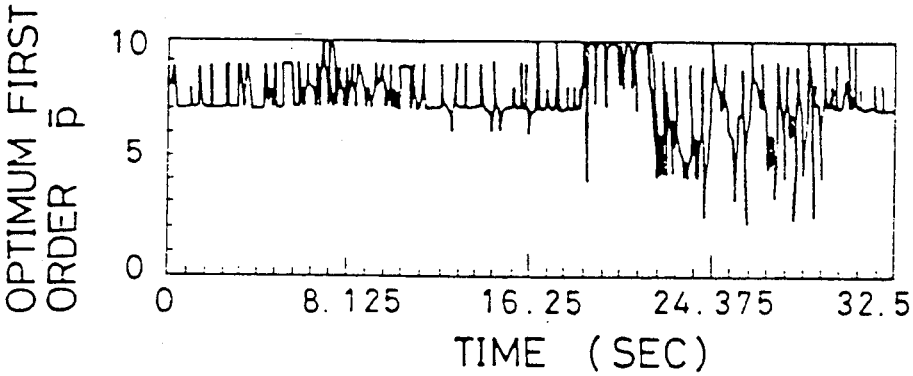
Figure 6C:
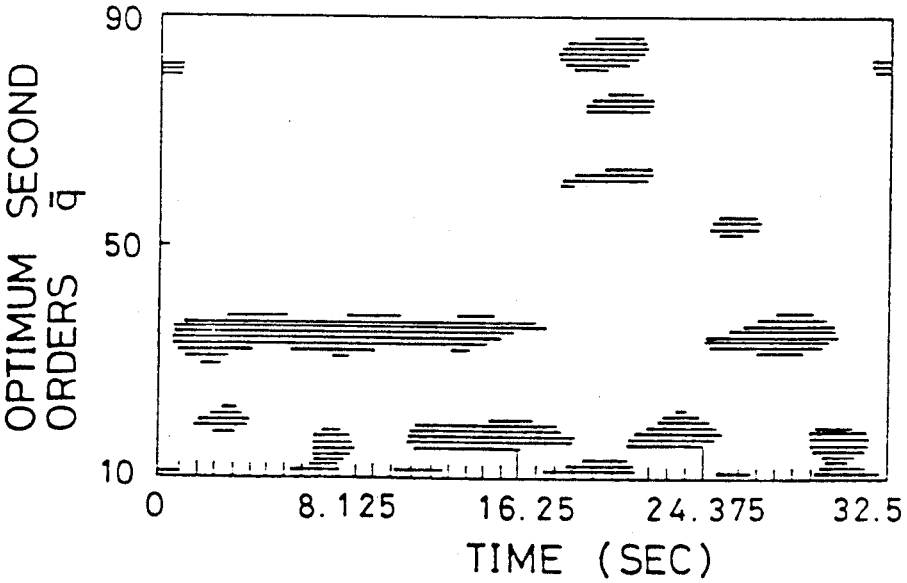

FIGS. 6A, 6B, and 6C illustrate features extracted from an input signal comprising a large number of frames. Time in seconds is indicated on the horizontal axis of all three drawings. FIG. 6A shows the input signal, the signal voltage being indicated on the vertical axis. FIG. 6B illustrates the optimim first order $\bar{p}$ as a function of time. FIG. 6C illustrates the optimum second orders $\bar{q}$ as a function of time. Changes in $\bar{p}$ and $\bar{q}$ can be seen to correspond to transient changes in the input signal. The values of $\bar{q}$ tend to cluster in groups representing, for example, signal components ascribable to different sources. If the input signal is an engine noise signal, different $\bar{q}$ groups might characterize sounds produced by different parts of the engine.

An advantage of the novel feature extraction method is its use of information entropy values to determine the optimum orders. The information entropy value provides a precise measure of the goodness of fit of a linear predictive model of a given order.

Another advantage is that the information entropy values are normalized according to the zero-order residual power. The extracted features therefore reflect the frequency structure of the input signal, rather than the signal level.

Yet another advantage is that the novel method is based on changes in the information entropy. This enables correct features to be extracted regardless of whether the input signal is stationary or nonstationary.

Still another advantage is that the novel feature extraction method provides multiple-order characterization of the input signal. The first-order feature $\bar{p}$ provides information about transmission path charcteristics, such as vocal-tract characteristics in the case of a voice input signal. The second-order features $\bar{q}$ provide information about, for example, the fundamental and harmonic frequency characteristics of the signal source. In one contemplated application, the first-order and second-order information are combined into a pattern and used to identify the signal source: for example, to identify different types of vehicles by their engine sounds.

Figure 7:
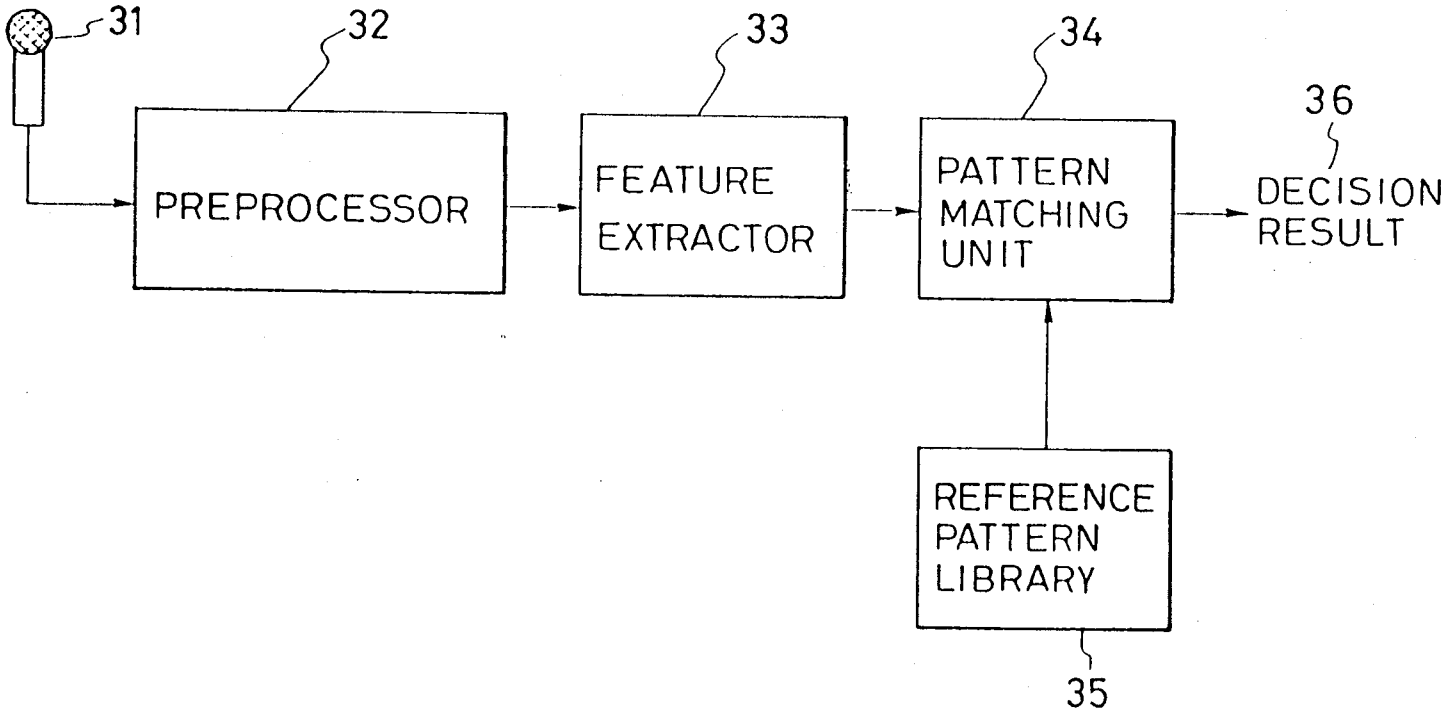
FIG. 7 is a block diagram illustrating an application of the invention.

The feature extractor of this invention can be used in many different applications, including speech recognition, speaker identification, speaker verification, and identification of nonhuman sources (for example, diagnosis of engine or machinery problems by identifying the malfunctioning part). To this end, the feature extractor of the invention can be incorporated into a system as shown in the block diagram of FIG. 7. The system, shown generally at 30, comprises a microphone 31 for picking up sound and converting it into electrical signals, as is known in the art. The electrical signals developed at the microphone 31 are delivered to a preprocessor 32 which processes the electrical signals into a form suitable for further processing. In this embodiment of the invention, the preprocessor 32 includes means for pre-emphasis of the signal and means for noise reduction, as are generally well known in the art.

After the electrical signals have been preprocessed in the preprocessor 32, the signals are delivered to a feature extractor 33 built according to the detailed description given above. The feature extractor 33 of this invention will extract the features of the electrical signals which represent the sound detected by the microphone 31.

The features developed by the feature extractor 33 are delivered to a pattern matching unit 34 which compares features from the feature extractor 33 to a reference pattern. The reference pattern is delivered to the pattern matching unit by a reference pattern library or dictionary 35. The reference pattern library 35 is used for storing reference patterns which correspond to features of standard sounds, words, etc., depending upon the particular application. The pattern matching unit 34 decides which reference pattern matches the extracted feature 33 most closely and produces a decision result 36 of that matching process.

The feature extractor, the reference pattern library and the pattern matching unit are generally in the form of a digital signal processing circuit with memory, and can be implemented by dedicated hardware or a program running on a general purpose computer or a combination of both.

The scope of this invention is not restricted to the embodiment described above, but includes many modifications and variations which will be apparent to one skilled in the art. For example, the algorithms used to carry out the linear predictive analyses can be altered in various ways, and different stages can be partly combined to eliminate redundant parts. In the extreme case, all stages can be telescoped into a single stage which recycles its own residuals as input.

What is claimed is:

1. A feature extractor apparatus for extracting features from an input signal, comprising the combination of:

sampling means for sampling said input signal to obtain a series of sample values; and two or more stages of linear predictive analyzers connected in series, the two or more stages including a first stage and a next stage; and where more than two of said stages are included, then including a first stage, a last stage, and one or more intermediate stages;

the first stage being coupled to receive said sample values, and configured to perform linear predictive analysis of different orders thereon, thus generating residuals, the first stage also being coupled to the next stage to receive therefrom information entropy values generated in the next stage, and being configured to select on the basis thereof an optimum order for output as a feature;

each intermediate stage being coupled to receive said residuals generated in the preceding stage, being configured to perform linear predictive analysis of different orders thereon, thus generating residuals and information entropy values, being coupled to receive information entropy values generated in the next stage, and being configured to select on the basis thereof an optimum order for output as a feature; and the last stage being coupled to receive residuals generated in the preceding stage, being configured to perform linear predictive analysis of different orders thereon, thus generating information entropy values, and to select on the basis of changes therein one or more optimum orders for output as featured.

2. The feature extractor of claim 1, wherein said first stage comprises:

first order decision means for storing and incrementing a first order p, receiving information entropy values from said intermediate or last stage, comparing the received information entropy values with a first threshold, and outputting said first order p as a feature when the received information entropy value exceeds said first threshold;

a first linear predictive analyzer for receiving said sample values from said sampling means and said first order p from said first order decision means, and calculating a set of linear predictive coefficients $a_1, \ldots, a_p$; and a first residual filter for receiving said sample values from said sampling means and said linear predictive coefficients $a_1, \ldots, a_p$, calculating predicted sample values from said linear predictive coefficients and said sample values, and subtracting said sample values, thereby generating a series of residuals.

3. The feature extractor of claim 2, wherein said first stage also comprises a whiteness evaluator for receiving from said intermediate or last stage information entropy values corresponding to different orders in said intermediate or last stage, mutually comparing said information entropy values, finding a whitening order beyond which said information entropy values decrease at a substantially constant rate, and furnishing said whitening order to said first order decision means.

4. The feature extractor of claim 1, wherein said intermediate or said last stage comprises:

a second linear predictive analyzer for receiving said residuals from said first stage, performing a second linear predictive analysis of a second order q on said residuals, and calculating a residual power $\sigma_q^2$ representative of mean square error in second linear predictive analysis;

an entropy calculator for receiving said error power $\sigma_q^2$ from said second linear predictive analyzer and calculating an information entropy value;

second order decision means for storing and incrementing said second order q, and providing said second order q to said second linear predictive analyzer.

5. The feature extractor of claim 4, wherein said second linear predictive analyzer also generates a set of q linear predictive coefficients $b_1, \ldots, b_q$, and said intermediate or said stage also comprises a second residual filter for receiving said residuals from said first stage and said linear predictive coefficients $b_1, \ldots, b_q$, calculating predicted residuals from said linear predictive coefficients and said residuals, and subtracting said residuals to obtain a further series of residual values.

6. The feature extractor of claim 4, wherein the second stage is the last stage, and said second order decision means also receives and stores information entropy values corresponding to different orders q from said entropy calculator, calculates therefrom a second threshold, and outputs as features those values of the second order q at which the change in said information entropy values exceeds said second threshold.

7. A feature extractor apparatus for extracting features from an input signal, comprising the combination of:

a sampling circuit coupled for sampling said input signal to obtain a series of sample values; and first and second stage circuits, the first stage circuit coupled to receive the series of sample values and configured to provide first residual signals e(p,n) to the second stage circuit, the second stage circuit coupled to receive the first residual signals and to provide second residual signals e(q,n) and to provide entropy signals h to said first stage circuit, each stage also providing output signals:

the first stage circuit including:

(a) a first residual filter coupled to said sampling circuit, and providing at an output said first residual signals e(p,n);

(b) a first linear predictive analyzer (LPA) having an input and an output, the input being coupled to receive signals provided from said sampling circuit, the first LPA being configured to perform first linear predictive analysis of first orders p on signals received at its input, the first LPA generating signals a and providing them on said output, said output being coupled to another input to the first residual filter;

(c) a whitening evaluation circuit coupled to receive said entropy signals h from the second stage circuit and configured to determine a whitening order q indicative of a characteristic of the entropy signals from the second stage circuit; and (d) a first order decision circuit coupled to the whiteness evaluation circuit and configured to provide incrementing first order p signals and to determine whether an information entropy value corresponding to said whitening order q exceeds a first threshold, the first order decision circuit providing said first order p signals to said first LPA, the first order decision circuit being configured to output as a first feature a signal indicative of the first order p at which the first threshold is passed;

the second stage circuit including:

(a) a second residual filter having one input coupled to receive the first residual signals e(p,n) of the first residual filter, the second residual filter providing at an output said second residual signals e(q,n);

(b) a second LPA having an input coupled to receive said first residual signals e(p,n), the second LPA being configured to perform second linear predictive analysis of different orders q on signals received at its input, thereby generating second residual signals b and an error signal representative of an error in the second linear predictive analysis;

(c) an entropy calculator coupled to receive said error signal generated by said second LPA and to provide said entropy signals h based thereon; and (d) a second order decision circuit coupled to receive said entropy signals h and configured to provide incrementing second order q signals and to determine whether said entropy signals h exceed a second threshold, the second order decision circuit providing said second order q signals to said second LPA, the second order decision circuit being configured to output as a second feature the second order at which the second threshold is passed.

8. The circuit of claim 7 wherein said first order decision circuit is coupled to receive entropy signals from the entropy calculator.

9. The circuit of claim 7 further comprising a third stage circuit coupled to receive said second residual signals e(q,n) and to determine and provide further entropy signals to said entropy calculator of said second stage circuit, and providing a third feature r as an output.

* * * * *